US005797548A

United States Patent [19]

Tamura et al.

[11] Patent Number: 5,797,548

[45] Date of Patent: Aug. 25, 1998

[54] SELF-PROPELLED CRUSHING MACHINE

[75] Inventors: Yukio Tamura; Mitsuhisa Sakae; Satoru Koyanagi; Toru Nakayama, all of Kawasaki, Japan

[73] Assignee: Komatsu Ltd., Tokyo, Japan

[21] Appl. No.: 624,458

[22] PCT Filed: Oct. 25, 1994

[86] PCT No.: PCT/JP94/01787

§ 371 Date: Apr. 4, 1996

§ 102(e) Date: Apr. 4, 1996

[87] PCT Pub. No.: WO95/11756

PCT Pub. Date: May 4, 1995

[30] Foreign Application Priority Data

Oct. 25, 1993 [JP] Japan ..... 5-266522

[51] Int. Cl.[6] ..... B02C 21/02; B02C 23/02

[52] U.S. Cl. ..... 241/35; 241/101.74; 241/186.2

[58] Field of Search ..... 241/34, 35, 36, 241/101.74, 186.2, 186.3, 202

[56] References Cited

U.S. PATENT DOCUMENTS

| | | | |
|---|---|---|---|
| 4,721,257 | 1/1988 | Williams et al. | 241/36 |
| 4,793,561 | 12/1988 | Burda | 241/36 |
| 5,074,435 | 12/1991 | Suverkrop et al. | 241/34 X |
| 5,566,893 | 10/1996 | Getz | 241/27 |
| 5,580,004 | 12/1996 | Tamura et al. | 241/36 |

FOREIGN PATENT DOCUMENTS

| | | |
|---|---|---|
| 62-40687 | 10/1987 | Japan . |
| 64-32744 | 3/1989 | Japan . |
| 1-247604 | 10/1989 | Japan . |
| 4-4029 | 1/1992 | Japan . |
| 54-31666 | 1/1992 | Japan . |
| 4-66142 | 3/1992 | Japan . |

*Primary Examiner*—John M. Husar

*Attorney, Agent, or Firm*—Frishauf, Holtz, Goodman, Langer & Chick

[57] ABSTRACT

In a self-propelled crushing machine having a vehicle body, a traveling body mounted on the lower portion of the vehicle body, a crusher mounted on the upper portion of the vehicle body, and a hopper mounted on the upper portions of the vehicle body having a feeder for supplying an object of crush to an inlet of the crusher, the self-traveling crushing machine includes crusher driving means for driving the crusher, an excessive load detector for detecting whether an excessive load is acting on the crusher driving means or not, a feeder driver for driving the feeder, and control means for stopping the feeder driver when excessive load is detected by the excessive load detector means and actuating the feeder driver when excessive load is not detected.

35 Claims, 10 Drawing Sheets

SELF-PROPELLED CRUSHING MACHINE

BACKGROUND OF THE INVENTION

1. Field of the Invention

The present invention relates to a selfpropelled crushing machine for crushing a concrete waste and so forth in a site of taking down a building or so forth.

2. Background Art

As a self-propelled crushing machine, the machine, in which a crusher, a hopper coupled with the crusher and a driving device for driving the crusher are mounted on a vehicle chassis having a pair of left and right traveling bodies, and a discharge conveyer is provided beneath the vehicle chassis and between the pair of traveling bodies for pivoting up and down, as disclosed in Japanese Unexamined Utility Model Publication No. Sho 64-32744, has been known.

Such self-propelled crushing machine can travel alone and can crush concrete waste and so forth charged into the hopper into small pieces and discharge the crushed pieces externally by means of the discharge conveyer.

On the other hand, in such self-propelled crushing machine, the crushing object is located into the hopper by means of a loader machine, such as a hydraulic shovel and so forth and the loaded crushing object is then fed into the crusher by the hopper to perform crushing. When the excessive amount of crushing object beyond a capacity of the crusher is fed into the crusher, namely, when the crushing object is supplied in the excessive supply condition the crusher may stop, or, in more significant case, the crusher Per se may be damaged.

Therefore, conventionally, in addition to the operator of the loader machine such as the hydraulic shovel and so forth, a worker for controlling driving of the crusher rides on the self-propelling crushing machine to cause emergency stop of the crusher in the case that the crushing object is excessively supplied to the crusher. Therefore, two workers are required. In addition, there is a danger that the crushing object contacts with the worker in error upon charging the crushing object into the hopper by the loader.

Therefore, it is an object to provide a selfpropelled crushing machine which can effectively crush the crushing object by a single worker and will avoid any danger of hitting the worker by the crushing object.

SUMMARY OF THE INVENTION

In order to accomplish the above-mentioned object, one aspect of a self-propelled crushing machine according to the present invention, in the self-propelled crushing machine having a vehicle body, a traveling body mounted on the lower portion of the vehicle body, a crusher mounted on the upper portion of the vehicle body, and a hopper mounted on the upper portion of the vehicle body and having a feeder for supplying an object of crush to an inlet of the crusher, comprises crusher driving means for driving the crusher, excessive load detecting means for detecting whether an excessive load is acting on the crusher driving means or not, feeder driving means for driving the feeder, and control means for stopping the feeder driving means when excessive load is detected by the excessive load detecting means and actuating the feeder driving means when excessive load is not detected.

With the construction set forth above, when crushing object is excessively supplied to the crusher and excessive load acts, the feeder stops automatically. Then, the supply of the crushing object to the crusher is terminated, and when the crushing object is crushed and excessive load in the crusher disappears, the feeder is actuated again. Accordingly, the crusher will continue operation without stopping or being damaged. Thus, by charging the crushing object into the hopper by a loader, the crushing object can be automatically crushed. Also, the worker is not required to visually observe the crusher to drive and stop the crusher. Therefore, crushing of the crushing object can be efficiently performed by a single worker without danger of being hit by the crushing object.

Preferably, the crusher driving means comprises a crusher motor and a switching valve for the crusher for controlling supply of a pressurized fluid to the crusher motor, the feeder driving means comprises a feeder motor and a switching valve for the feeder for controlling supply of a pressurized fluid to the feeder motor, the excessive load detecting means is a revolution sensor detecting revolution of the crusher motor and detecting the revolution speed lower than or equal to a predetermined revolution speed as excessive load condition, and the control means is a controller which switches the switching valve for the feeder into a closed position when the revolution speed detected by the revolution speed sensor is lower than or equal to the predetermined revolution speed and switches the switching valve for feeder into a open position when the revolution speed exceeds the predetermined revolution speed.

On the other hand, in another aspect of a selfpropelled crushing machine according to the present invention, in a self-propelled crushing machine having a vehicle body, a traveling body mounted on the lower portion of the vehicle body, a crusher mounted on the upper portion of the vehicle body, a hopper mounted on the upper portion of the vehicle body and having a feeder for supplying an object of crush to an inlet of the crusher, a discharge conveyer mounted on the lower portion of the vehicle body and receiving a crushed piece from an outlet of the crusher, comprises crusher driving means for driving the crusher, first excessive load detecting means for detecting whether an excessive load is acting on the crusher driving means or not, discharge conveyer driving means for driving the discharge conveyer, second excessive load detecting means for detecting whether an excessive load is acting on the conveyer driving means, feeder driving means for driving the feeder, and control means for stopping the feeder driving means when excessive load is detected by at least one of the first and second excessive load detecting means and actuating the feeder driving means when excessive load is not detected by both of the first and second excessive load detecting means.

With the construction set forth above, even when the excessive load acts on the discharge conveyer in addition to the crusher, the feeder can be automatically stopped. When the excessive load on the discharge conveyer disappears, the feeder starts operation automatically. Therefore, crushing of the crushing object can be performed further efficiently by a single worker.

Preferably, the crusher driving means comprises a crusher motor and a switching valve for the crusher for controlling supply of a pressurized fluid to the crusher motor, the feeder driving means comprises a feeder motor and a switching valve for the feeder for controlling supply of a pressurized fluid to the feeder motor, the conveyer driving means comprises a conveyer motor and a switching valve for the conveyer for controlling supply of a pressurized fluid to the conveyer motor, the first excessive load detecting means is a revolution sensor detecting revolution of the crusher motor and detecting the revolution speed lower than or equal to a predetermined revolution speed as excessive load condition, the second excessive load detecting means is a pressure sensor for detecting a driving hydraulic pressure of the conveyer motor to detect the driving hydraulic pressure higher than or equal to the predetermined hydraulic pressure as excessive load condition, and the control means is a controller which switches the switching valve for the feeder into a closed position when the revolution speed detected by the revolution speed sensor is lower than or equal to the predetermined revolution speed and/or when the hydraulic pressure detected by the pressure sensor is higher than or equal to the predetermined pressure, and switches the switching valve for the feeder into a open position when the revolution speed exceeds the predetermined revolution speed and the hydraulic pressure is lower than the predetermined pressure.

The self-propelled crushing machine may further comprise crusher inching means for inching the crusher driving means in normal and reverse directions. In this case, the crusher inching means is preferably a crusher normal drive switch and a crusher reverse drive switch for temporarily placing the crusher driving means in normal or reverse driving condition.

On the other hand, the self-propelled crushing machine may further comprise feeder inching means for inching the feeder driving means. In this case, the feeder inching means is preferably a feeder driving switch for placing the feeder driving means in temporarily actuating condition by manual operation.

Also, a pair of first vertical panels and a second vertical panel forming the hopper may have an upper portion pivotable in the vertical direction.

On the other hand, a magnetic ore separator may be mounted on the vehicle body in opposition of the discharge conveyer.

Also, a switching valve for attachment connected to a driving power source of a main body of the vehicle and a vehicle body side connecting portion connected to the switching valve for attachment may be provided on the vehicle body, the vehicle body side connecting portion is connected to driving motors of various attachment via piping members.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

Figure 1:
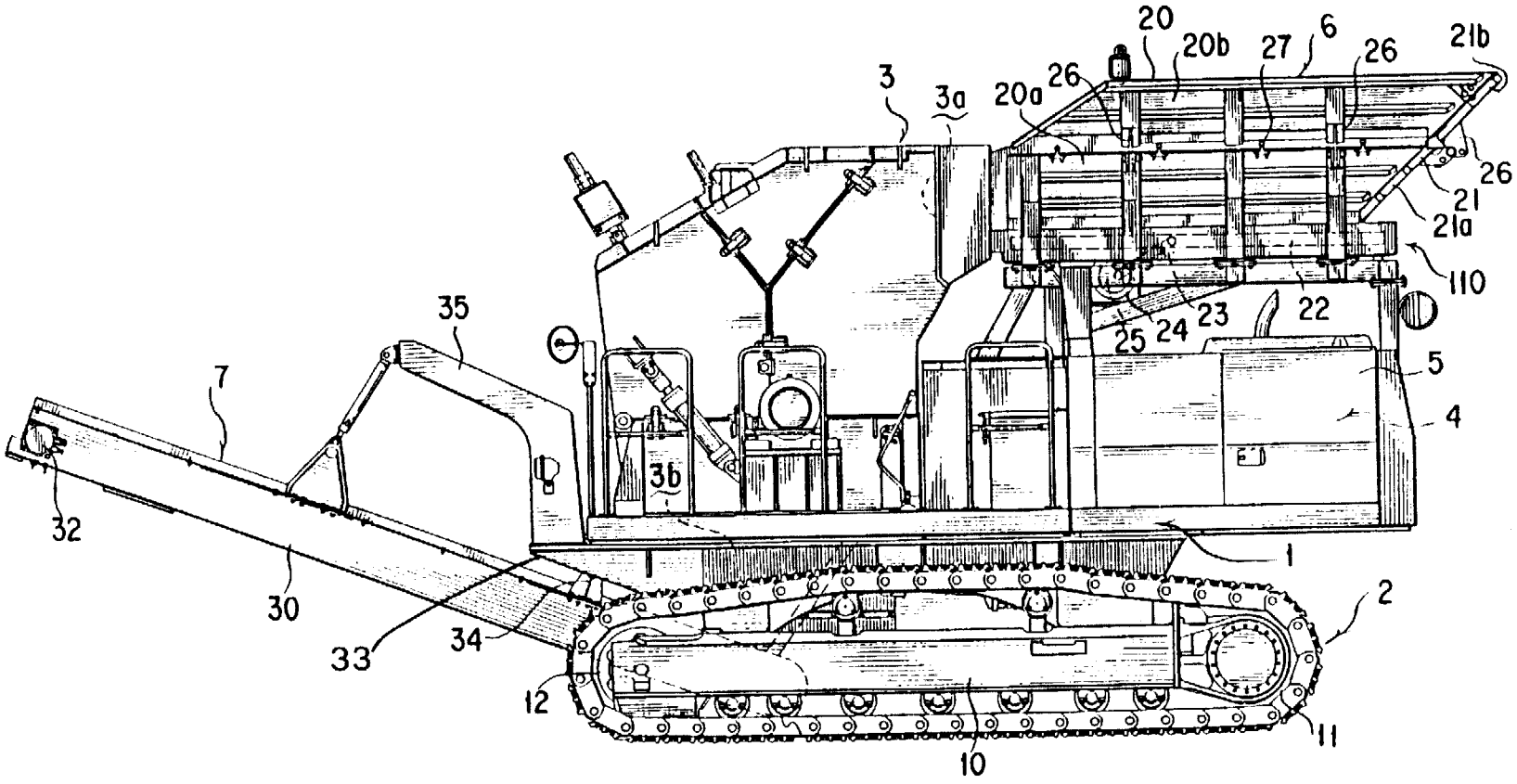
FIG. 1 is a front elevation showing a basic construction of one embodiment of a self-propelled crushing machine according to the present invention.
Figure 2:
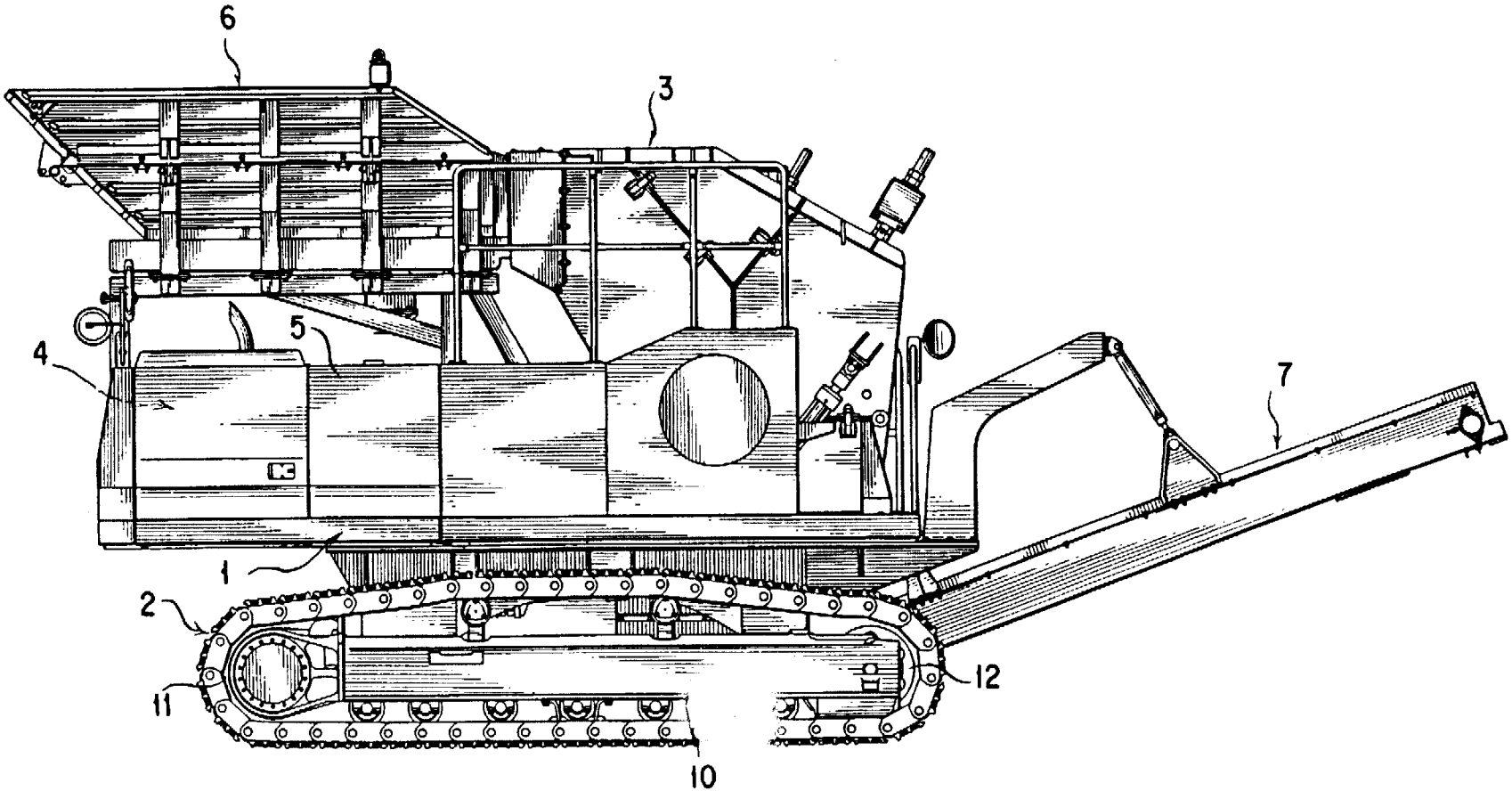
FIG. 2 is a back elevation showing the basic construction of the above-mentioned embodiment.
Figure 3:
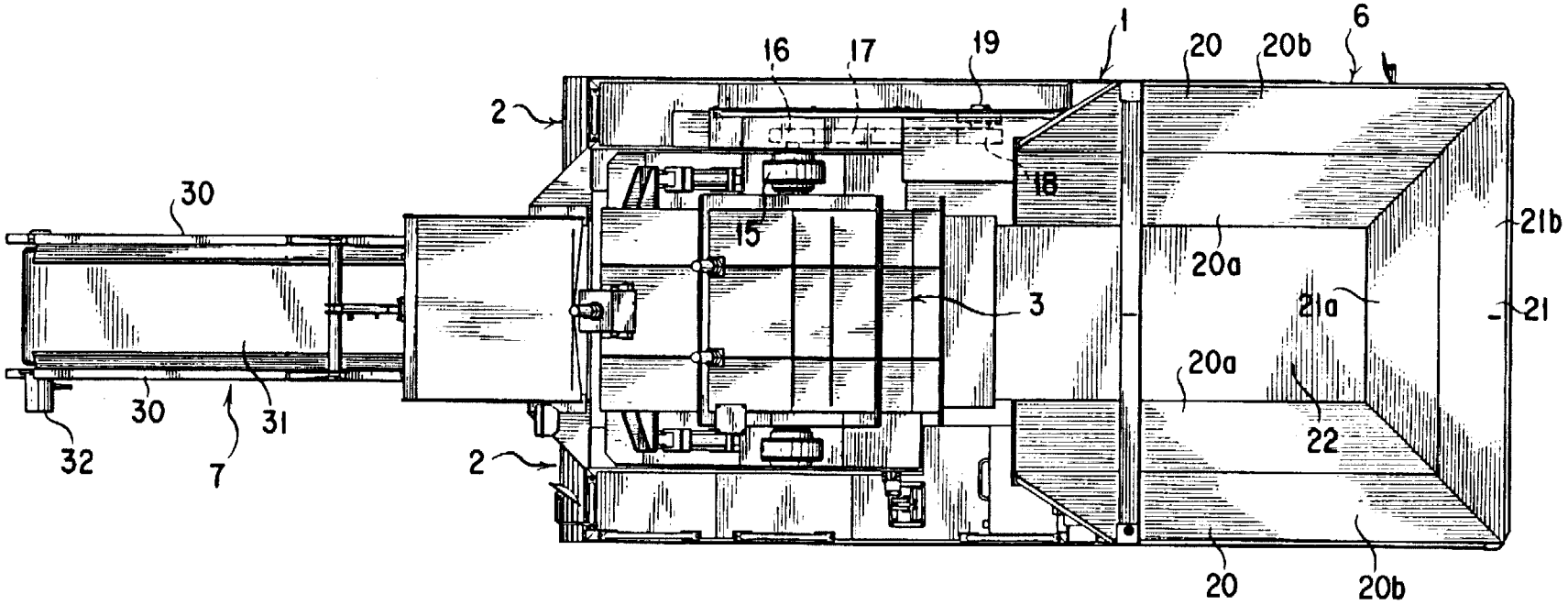
FIG. 3 is a plan view showing the basic construction of the above-mentioned embodiment.
Figure 4:
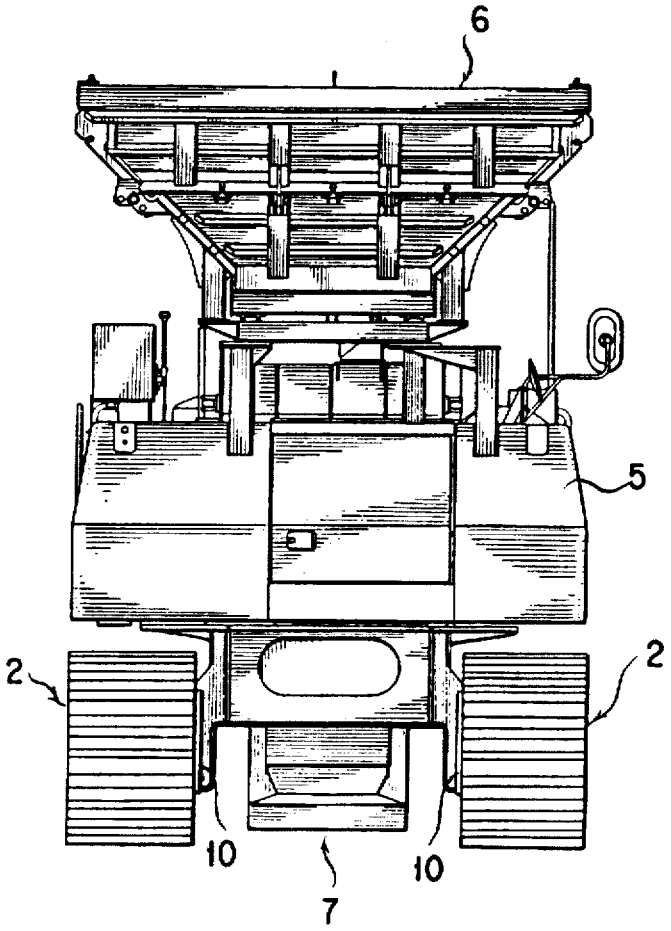
FIG. 4 is a right side elevation showing the basic construction of the above-mentioned embodiment.
Figure 5:
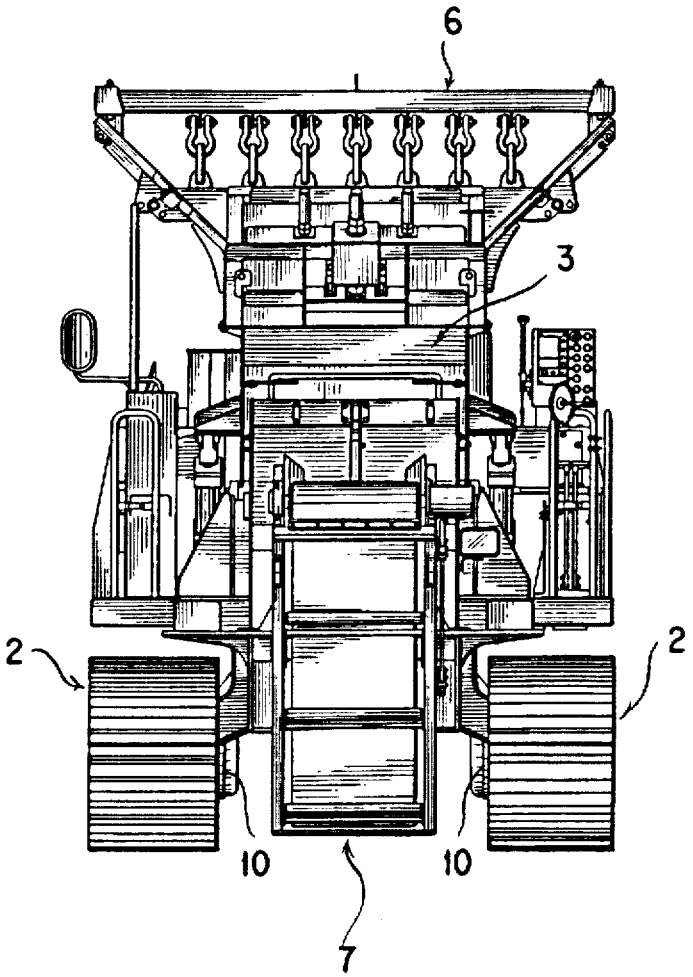
FIG. 5 is a left side elevation showing the basic construction of the above-mentioned embodiment.
Figure 6:
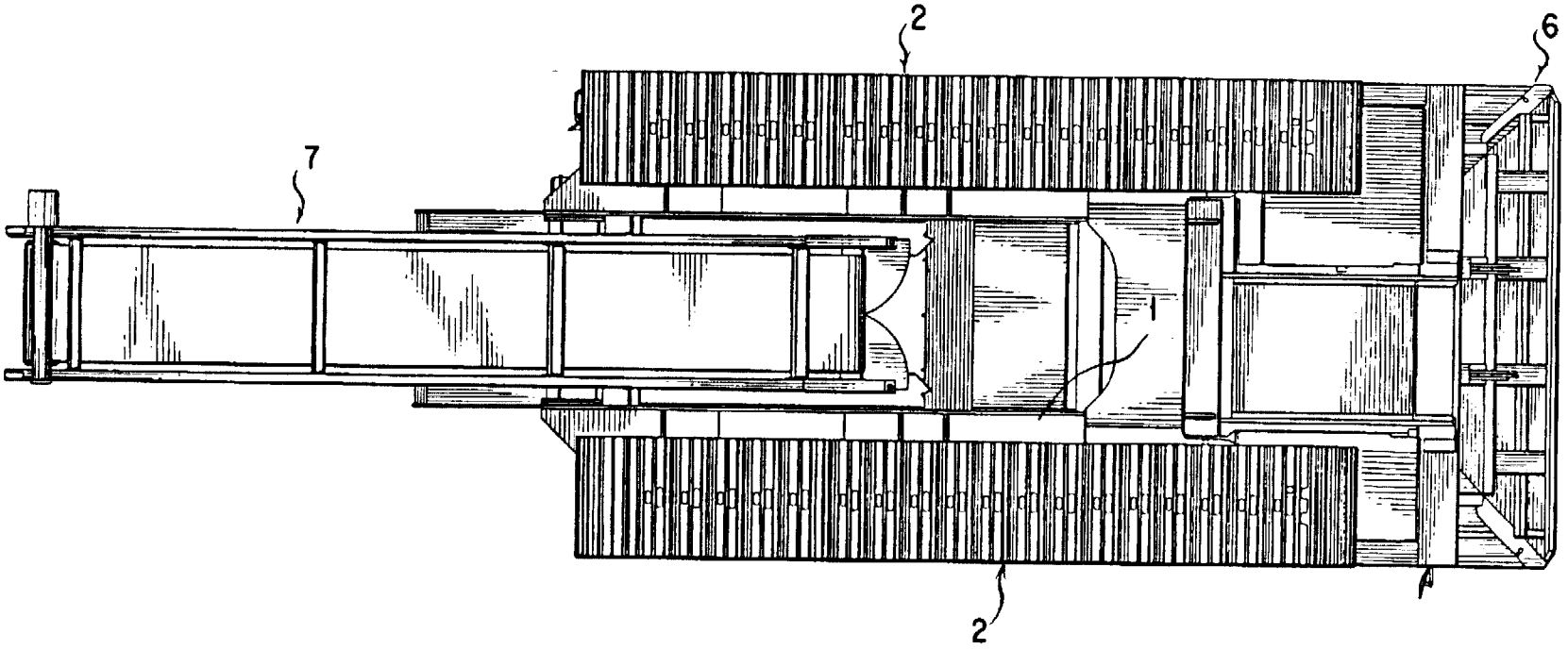
FIG. 6 is a bottom view showing the basic construction of the above-mentioned embodiment.

The preferred embodiment of a self-propelled crushing machine according to the present invention will be discussed hereinafter with reference to the accompanying drawings.

(Basic Construction of the Overall Self-Propelled Crushing Machine)

As shown in FIGS. 1 to 6, the base construction of one embodiment of a self-propelled crushing machine according to the present invention is constructed with a vehicle body 1, a pair of left and right traveling bodies 2, 2 mounted at the lower portion of the vehicle body 1, a crusher 3 mounted at the upper portion of the vehicle body 1 at the frontwardly shifted position, a driving power source 4 mounted on the vehicle at the rearwardly shifted position, a cover body 5 covering the driving power source 4, a hopper 6 mounted on the cover body 5 and connected to an inlet of the crusher 3, and a discharge conveyer 7 mounted at the lower portion of the vehicle body and located between the pair of left and right traveling bodies 2, 2 in vertically pivotable fashion.

Figure 7:
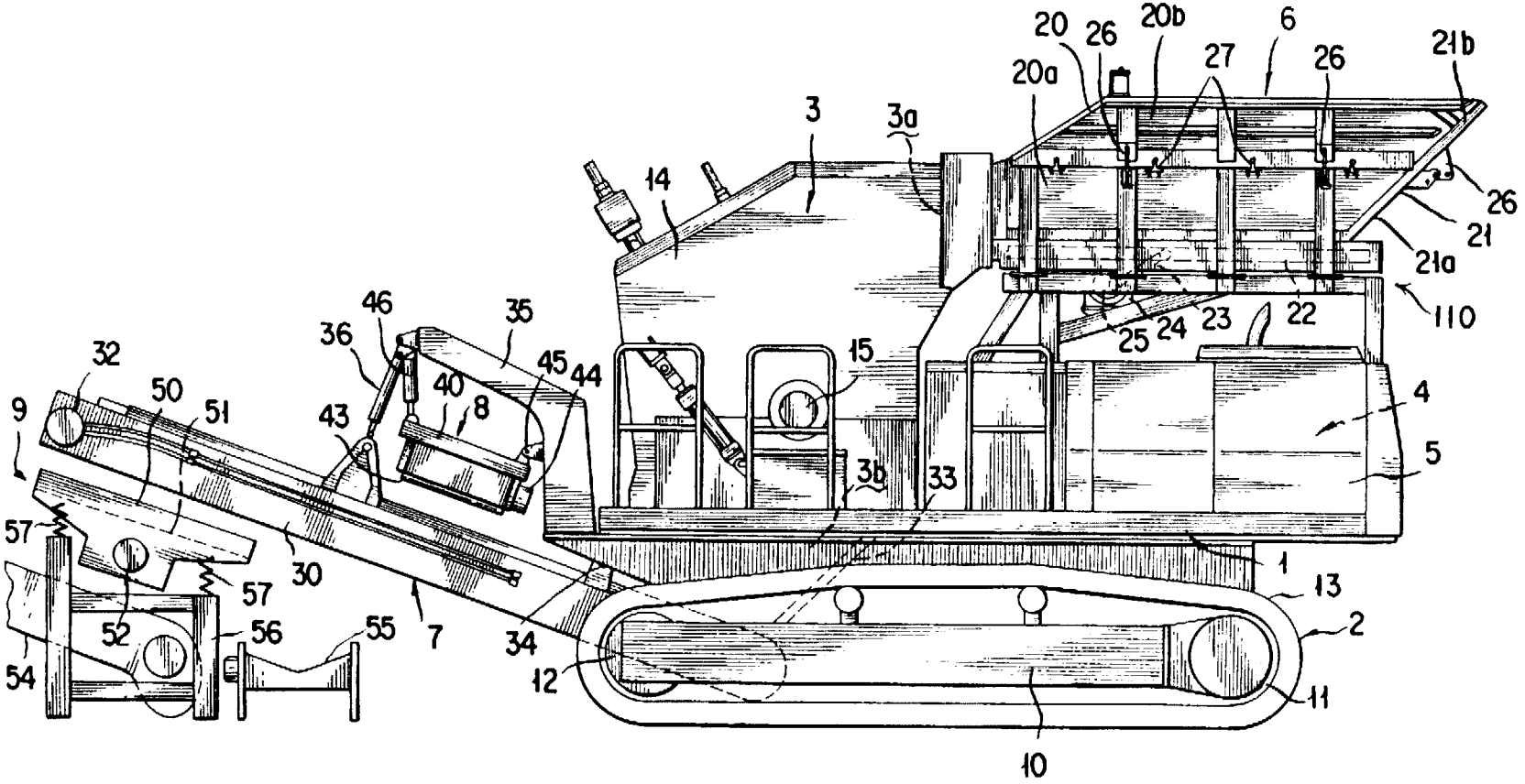
FIG. 7 is a front elevation showing a state mounting an attachment in the above-mentioned embodiment.
Figure 8:
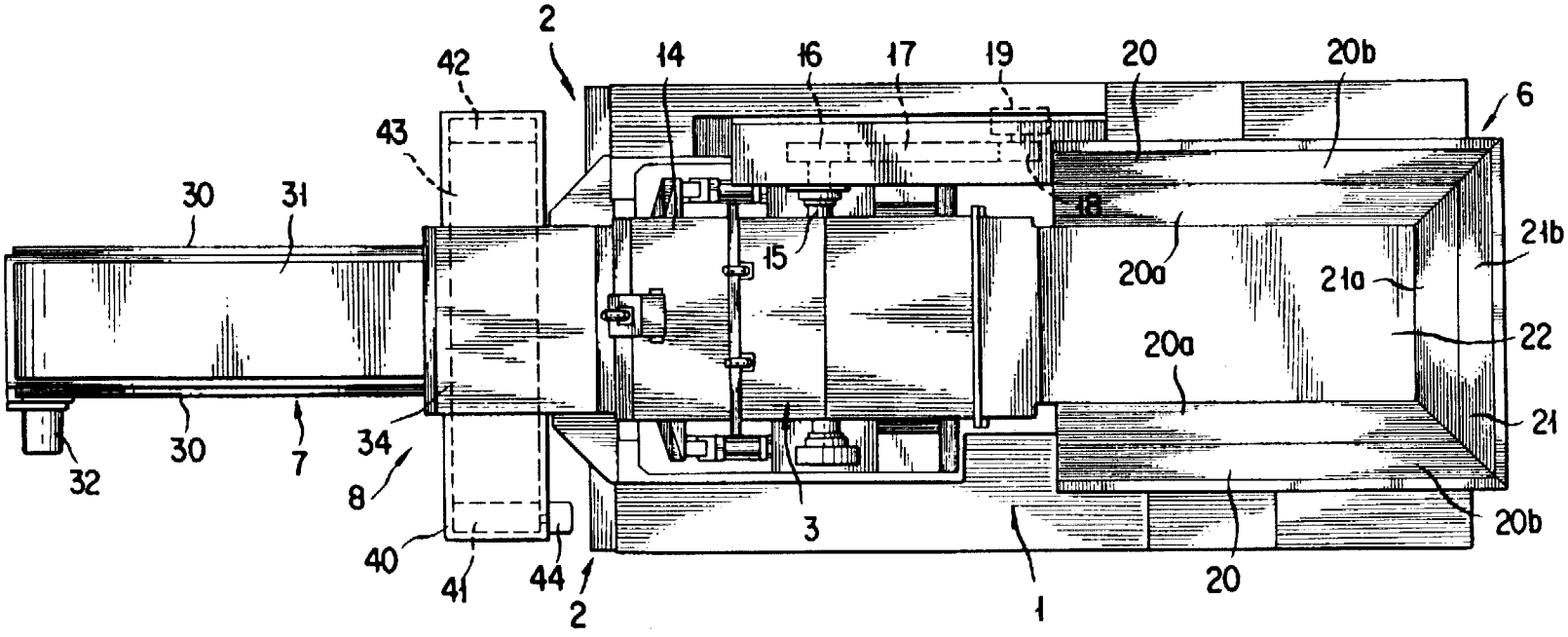
FIG. 8 is a plan view showing the condition shown in FIG. 7.

In the above-mentioned embodiment, in addition to the basic construction as set forth above, a magnetic ore separator 8 mounted on the front end portion of the vehicle body 1 and located above the discharge conveyer 7 and vibration-type screen 9 mounted at the discharge side of the discharge conveyer 7 are provided as attachments, as shown in FIGS. 7 and 8.

(Concrete Construction of Traveling Body 2)

The traveling body 2 is a crawler type traveling body constructed by providing a sprocket 11 and an idler 12 at the rear end and front end of a truck frame 10 mounted at each of left and right lower portions of the vehicle body, and winding a crawler 13 over the sprocket 11 and the idler 12.

(Concrete Construction of Crusher 3)

The crusher 3 is an impact type crusher, in which a plurality of hummers (not shown) are mounted on a rotary shaft 15 rotatably supported on a housing 14. The rotary shaft 15 is connected to a crusher motor 19 via a pulley 16, a belt 17 and a pulley 18. The crusher 3 crushes the crushing object charged through an inlet **3*a* and discharges through an outlet 3*b***.

(Concrete Construction of Hopper 6)

The hopper 6 is constructed into an upwardly and frontwardly opened box-shaped configuration with a pair of mutually opposing first vertical panels 20, 20 at both of left and right sides, a second vertical panel 21 at the rear side and a bottom plate 22. The bottom plate 22 is supported for reciprocal movement toward and away from the inlet 3a of the crusher 3. A link 23 pivotably connected to the bottom plate 22 at one end is pivotably connected to a circular disc 25 which is driven to rotate by means of a feeder motor 24, at the other end. Thus, by actuating the feeder motor 24, the bottom plate 22 is driven to reciprocate with respect to the inlet **3*a* of the crusher 3** for automatically feeding an object of crush charged into the hopper into the crusher 3. These form a feeder 110.

The first vertical panels 20 of the hopper 6 are constructed by connecting the lower end edge of an upper movable vertical panel 20*b* to the upper end edge of a lower stationary vertical panel 20*a* by means of a hinge 26 for pivotal motion in the vertical direction and by fixing the upper movable vertical panel 20*b* by means of a bolt 27 to maintain at a raised position. Similarly, the second vertical panel 21 of the hopper 6 is constructed by connecting the lower end edge of an upper movable vertical panel 21*b* to the upper end edge of a lower stationary vertical panel 21*a* by means of the hinge 26 and by fixing the upper movable vertical panel 21*b* by the bolt 27 to maintain at a raised position. Then, upon operation, the upper vertical panels 20*b* and 21*b* are fixed at the raised position to accommodate a large amount of crushing object within the hopper 6. On the other hand, upon transporting the self-propelled crushing machine with loading on a truck or so forth, the bolts 27 are loosened for pivoting down the upper movable vertical panels 20*b* and 21*b* to lower the height of the hopper so as not to be higher than the overall height of the selfpropelled crushing machine.

(Concrete Construction of Discharge Conveyer 7)

The discharge conveyer 7 is constructed by connecting a pair of left and right frames 30, 30 in spaced apart relationship, providing a not shown driving pulley and driven pulley between the frames 30, 30, winding a belt 31 around the pulleys, and directly driving a driving sprocket by a conveyer motor 32 provided on the frame 30. The rear end portion of the frames 30 is located below a discharge guide 33 which is provided at the outlet 3*b* of the crusher and has flexibility. On the other hand, the frames 30 are supported on the vehicle body 1 by means of pins 34 in vertically pivotable fashion. Between a support frame 35 mounted on the vehicle body 1 and the frames 30, a cylinder 36 is mounted, pivotally connecting both ends respectively thereto.

(Concrete Construction of Magnetic Ore Separator)

The magnetic ore separator is constructed by providing a driving pulley 41 and a driven pulley 42 at the left and right ends of a main body 40, winding a magnetic belt 43 around both pulleys 41 and 42, and driving the driving pulley 41 by means of a motor 44 for the magnetic ore separator. The main body 40 is supported on the downwardly shifted portion of the support frame 35 by means of a pin 45 in vertically pivotable fashion. Between the main body 40 and the upper portion of the tip end of the support frame 35, an expandable member 46, such as a turn buckle and so forth is connected by pivoting at both ends.

By this, the magnetic ore separator 8 is arranged so that the magnetic conveyer 43 is movable in a direction transverse to the discharge conveyer 7 above the discharge conveyer 7. Then, by expanding and contracting the expandable member 46, the magnetic ore separator 8 is pivoted in the vertical direction to move toward and away from the discharge conveyer 7.

(Concrete Construction of Vibration-Type Screen)

The vibration type screen is constructed by mounting a screen 51 within the discharge hopper 50, providing a not shown vibration generator having a vibration generating motor 52 on the discharge hopper 50, and mounting the discharge hopper 50 on a platform 56 provided below the conveyer 7, via an elastic member 57. Then, when the crushed pieces are dropped on the screen 51, smaller crushed pieces are dropped onto a secondary belt conveyer 54 through the screen 51 and large crushed pieces are dropped onto a third belt conveyer 55 along the screen 51. By this, the large crushed pieces and the small crushed pieces can be separated.

A hydraulic circuit of the shown embodiment is constructed as follow.

Figure 9:
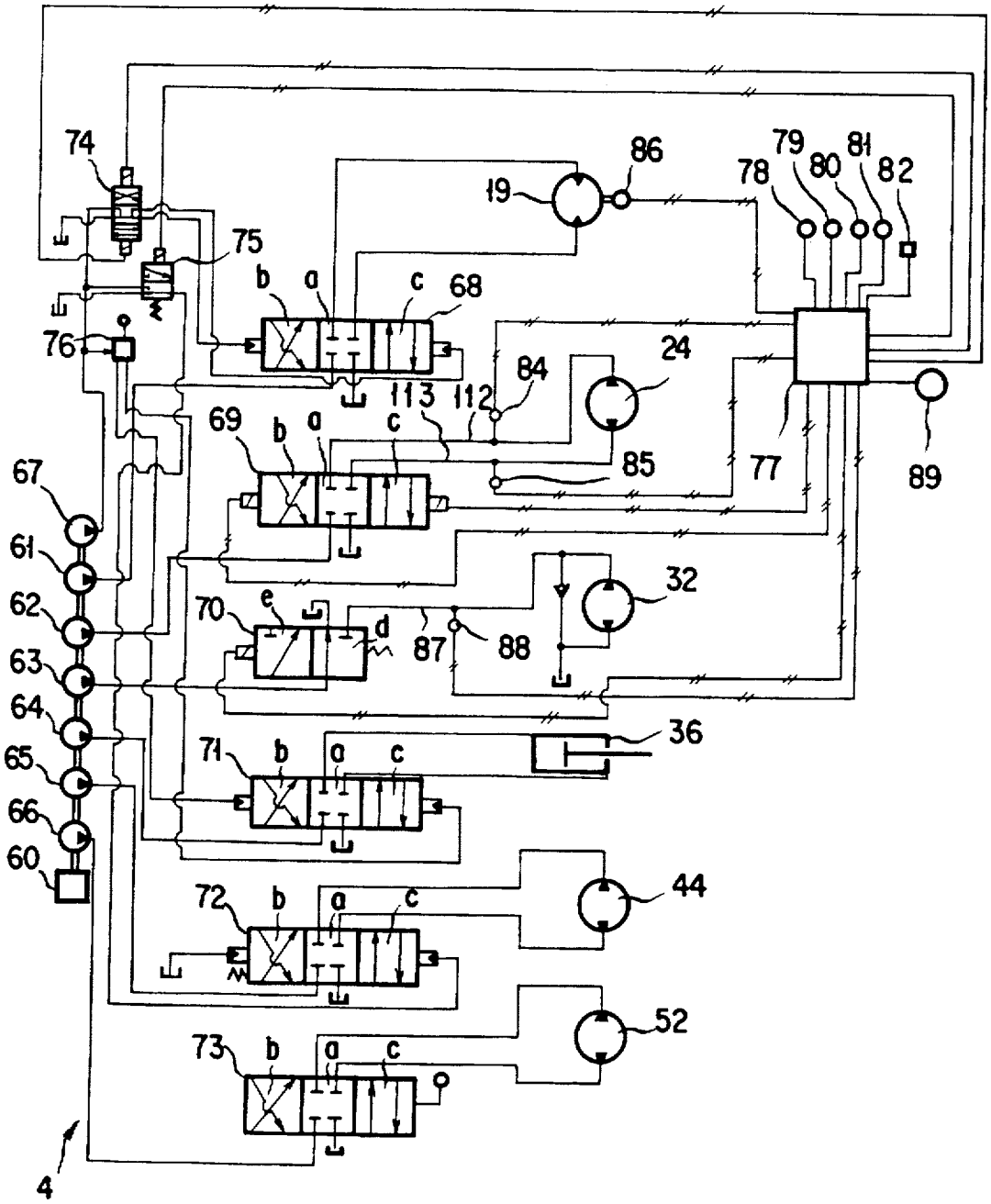
FIG. 9 is a hydraulic circuit diagram of the above-mentioned embodiment.

As shown in FIG. 9, in the hydraulic circuit, there are provided an engine 60, first, second, third, fourth, fifth, sixth and seventh hydraulic pumps 61, 62, 63, 64, 65, 66 and 67, a switching valve 68 for the crusher, a switching valve 69 for the feeder, a switching valve 70 for the conveyer, a switching valve 71 for a lift, a switching valve 72 for the magnetic ore separator, a switching valve 73 for vibration from the driving power source 4. Then, the switching valves 68 for the crusher and the switching valve 72 for the magnetic ore separator are switched from neutral positions a to first positions b or second positions c by a pilot fluid pressure from first and second electromagnetic switching valves 74 and 75. The switching valve 71 for lift is switched from the neutral position a to the first position b or the second position c by the pilot fluid pressure from a pilot valve 76. On the other hand, the first and second electromagnetic switching valves 74 and 75 and the switching valve 69 for the feeder are switched from the neutral position a to the first position b or the second position c by electric power supply from a controller 77. The switching valve 70 for conveyer is switched to a drain position d or a supply position e by electrical power supply from the controller 77. The switching valve 73 for vibration is switched from the neutral position a to the first position b or the second position c by manual operation.

It should be noted that the hydraulic circuit diagram merely shows flow of a working fluid. In practice, the hydraulic circuit is provided with relief valves counter balance valves and so forth. However, in order to keep the disclosure simple enough, these components of the hydraulic circuit are neglected from illustration.

To the controller 77, signals are input from a crusher normal drive switch 78, a crusher reverse drive switch 79, a feeder inching switch 80, a magnetic ore separator drive switch 81, and automatic operation switch 82. Also, to the controller 77, signals are input from first and second pressure switches 84 and 85 provided in first and second primary circuits 112 and 113 connected to the switching valve 69 for the feeder and the feeder motor 24. A crusher revolution speed is input to the controller 77 from a revolution speed sensor 86 provided in the crusher motor 19. Also, a signal from a pressure sensor 88 provided in a main circuit 87 connected between the conveyer motor 32 and the switching valve 70 for the conveyer is input to the controller 77.

Next, function of the controller will be discussed. When an automatic operation signal is input from the automatic operation switch 82:

The controller 77 supplies an electric power to the first electromagnetic valve 74 to switch the first electromagnetic valve 74 to the first position a. By this, the switching valve 68 is switched into the first position b to supply the discharged pressurized fluid of the first hydraulic pump 61 to the crusher motor 19 to drive the latter in normal direction.

The revolution speed of the crusher motor 19 is detected by the revolution speed sensor 86 and input to the controller 77. When the revolution speed exceeds a value corresponding to 1000 r.p.m. of the revolution speed of the crusher, the controller 77 supplies the electric power to the switching valve 69 for the feeder to switch the switching valve 69 for the feeder to the first position b. By this, the discharged pressurized fluid of the second hydraulic pump 62 is supplied to the feeder motor 24 to drive the feeder 110 to sequentially supply the crushing object in the hopper 6 into the crusher 3.

In conjunction therewith, the controller 77 supplies the electric power to the switching valve 70 for the conveyer to switch the switching valve 70 for the conveyer to the supply position 3 to feed the discharged pressurized fluid of the third hydraulic pump 63 to the conveyer motor 32 to drive the discharge conveyer 7 to discharge the crushed pieces out of the vehicle body.

At this time, by expanding or contracting the cylinder 36 by operating the pilot valve 76, the height of the discharge conveyer 7 is preliminarily set. Also, by turning on the magnetic ore separator drive switch 81, the motor 44 of the magnetic ore separator is driven.

Here, when lowering of the revolution speed of the crusher motor 19 below 900 r.p.m. due to excessive supply of the crushing object into the crusher during the operation set forth above is detected by the revolution speed sensor 86, the controller 77 terminates power supply for the switching valve 69 for the feeder to return the switching valve 69 of the feeder to the neutral position a to stop the feeder motor 24. In conjunction therewith, an alarm member 89, such as a lamp or alarm buzzer and so forth is actuated.

On the other hand, discharging becomes impossible due to plugging of the crushed object in the discharge conveyer during the operation set forth above, the rotational load on the conveyer motor 32 becomes large so that an excessive load signal is input to the controller 77 from the pressure sensor 88. By this, the controller 77 stops the feeder motor 24 and, in conjunction therewith, actuates the alarm member 89, in the similar manner to that set forth above.

Upon inspection and maintenance, the crusher 3 is driven in normal or reverse direction by depressing the crusher normal drive switch 78 or the crusher reverse drive switch 79. Also, the feeder 110 is actuated by depressing a feeder drive switch 80. Thus, the bottom plate 22 is driven to reciprocate.

It should be noted that when the automatic operation switch 82 is depressed, the operational mode becomes the automatic operation mode even when another switch is operated.

In the shown embodiment, the magnetic ore separator 8, the vibration type screen 9, the secondary belt conveyer 54, the third belt conveyer 55 are to be mounted only in the case of special self-propelled crushing machine as the attachment. In this case, particularly, if the vibration type screen 8, a secondary belt conveyer 54, the third belt conveyer 55 are installed in the surface of the earth, it becomes necessary to place the driving power source on the earth.

Figure 10:
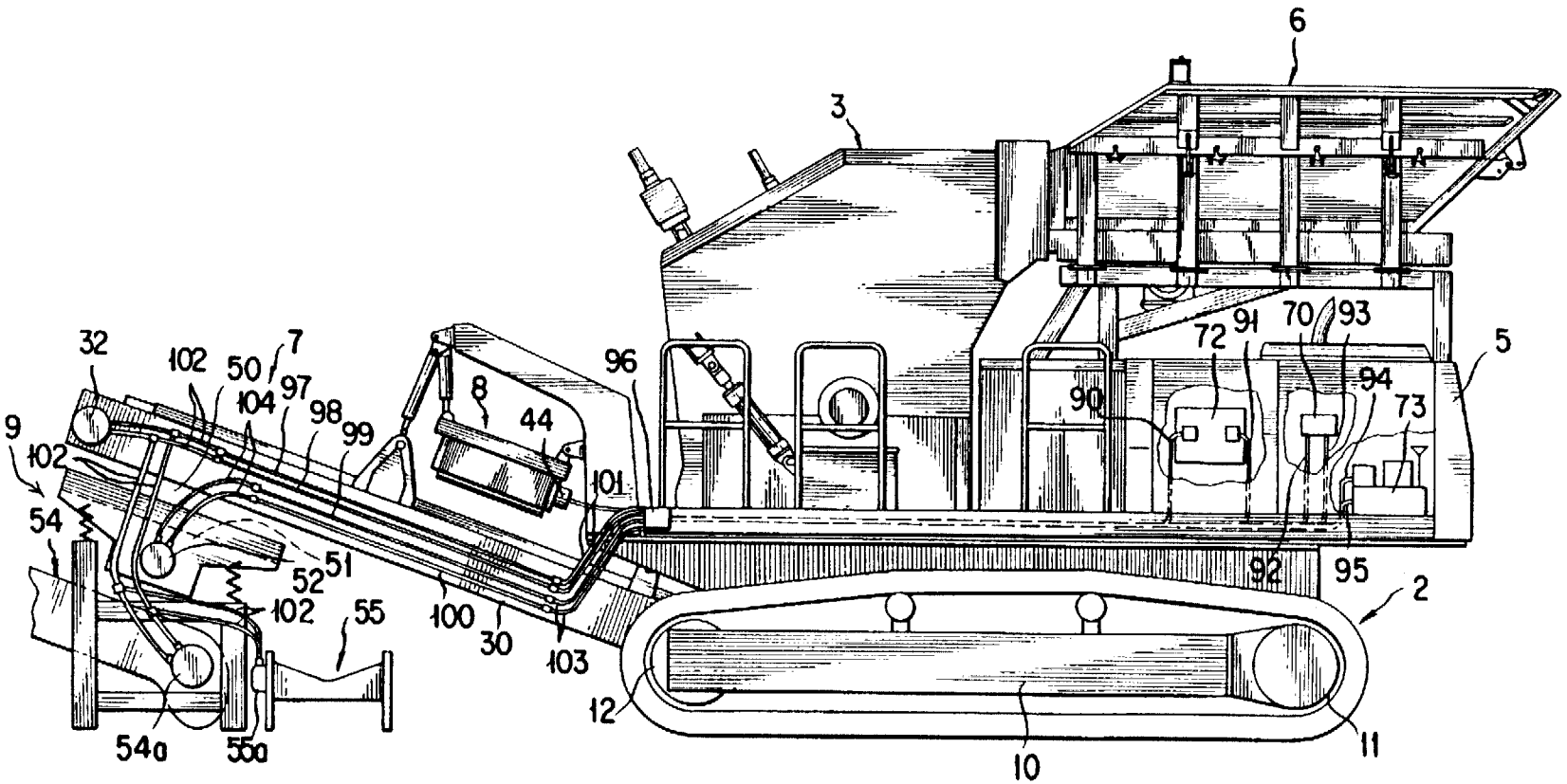
FIG. 10 is an illustration showing a piping structure of another embodiment of an attachment for the self-propelled crushing machine according to the invention.

However, by constructing as in another embodiment illustrated in FIG. 10, the driving power source 4 mounted on the vehicle body 1 can be utilized.

Namely, as shown in FIG. 10, the switching valve 70 for conveyer, the switching valve 72 for the magnetic ore separator and the switching valve 73 for vibration are provided within the cover body 5. First and second passages 90 and 91 are connected to the switching valve 72 for the magnetic ore separator. Third and fourth passages 92 and 93 connected to the switching valve 70 for the conveyer and the fifth and sixth passages 94 and 95 connected to the switching valve 73 for vibration are connected to vehicle body side connecting portion 96, such as the quick coupler arranged in the vicinity of the front end of the vehicle body 1.

Also, along the frame 30 of the discharge conveyer 7, first to fourth pipings 97, 98, 99 and 100 are mounted. One end of the first and second pipings 97 and 98 are connected to the vehicle body side connecting portion 96 via a hose 101. Then, the first and second pipings 97 and 98 are connected to the third and fourth pipings 92 and 93. The other end of the first and second pipings 97 and 98 are separately connected to the conveyer motor 32, the conveyer motor 54*a* of the secondary belt conveyer 54 and the conveyer motor 55*a* of the third belt conveyer 55 via the hose 102.

On the other hand, one end of the third and fourth pipings 99 and 100 are connected to the vehicle body side connecting portion 96 via the hose 103 to establish communication between the third and fourth pipings 99 and 100 and the fifth and sixth pipings 94 and 95. The other end of the third and forth pipings 99 and 100 are connected to the motor 52 for generating vibration via the hose 104.

It should be noted that the positions of the above-mentioned crusher 3, the driving power source 4, the hopper 6 and the discharge conveyer 7 may be opposite in the longitudinal direction to the foregoing embodiment.

Also, the contents of the commonly owned international applications Nos. PCT/JP93/01312, PCT/JP93/01313 and PCT/JP94/00298 are herein incorporated by reference.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

We claim:

1. A self-propelled crushing machine comprising:

a vehicle body;

a travelling body mounted on a lower portion of said vehicle body;

a crusher mounted on an upper portion of said vehicle body;

a hopper mounted on the upper portion of said vehicle body and having a feeder for supplying an object to be crushed to an inlet of said crusher;

a crusher driving unit for driving said crusher, said crusher driving unit comprising a crusher motor and a switching valve for the crusher, said switching valve controlling supply of a pressurized fluid to said crusher motor;

an excessive load detector for detecting whether or not an excessive load is acting on said crusher driving unit, said excessive load detector comprising a revolution sensor for detecting revolution of said crusher motor and for detecting a revolution speed thereof lower than or equal to a predetermined revolution speed as an excessive load condition;

a feeder driving unit for driving said feeder, said feeder driving unit comprising a feeder motor and a feeder switching valve, said feeder switching valve controlling supply of a pressurized fluid to said feeder motor; and a control unit for stopping said feeder driving unit when an excessive load is detected by said excessive load detector, and actuating said feeder driving unit when an excessive load is not detected, said control unit comprising a controller which switches said feeder switching valve into a closed position when the revolution speed detected by said revolution sensor is lower than or equal to the predetermined revolution speed, and which switches said feeder switching valve into an open position when the detected revolution speed exceeds said predetermined revolution speed.

2. A self-propelled crushing machine comprising:

a vehicle body;

a travelling body mounted on a lower portion of said vehicle body;

a crusher mounted on an upper portion of said vehicle body;

a hopper mounted on the upper portion of said vehicle body and having a feeder for supplying an object to be crushed to an inlet of said crusher;

a discharge conveyor mounted on the lower portion of said vehicle body and receiving crushed pieces from an outlet of said crusher;

a crusher driving unit for driving said crusher, said crusher driving unit comprising a crusher motor and a switching valve for the crusher, said switching valve controlling supply of a pressurized fluid to said crusher motor;

a first excessive load detector for detecting whether or not an excessive load is acting on said crusher driving unit, said first excessive load detector comprising a revolution sensor for detecting revolution of said crusher motor and for detecting a revolution speed thereof lower than or equal to a predetermined revolution speed as an excessive load condition;

a discharge conveyor driving unit for driving said discharge conveyor, said discharge conveyor driving unit comprising a conveyor motor and a switching valve for the conveyor, said switching valve for the conveyor controlling supply of a pressurized fluid to said conveyor motor;

a second excessive load detector for detecting whether or not an excessive load is acting on said conveyor driving unit, said second excessive load detector comprising a pressure sensor for detecting a hydraulic driving pressure of said conveyor motor so as to detect a hydraulic driving pressure which is higher than or equal to a predetermined hydraulic pressure as an excessive load condition;

a feeder driving unit for driving said feeder, said feeder driving unit comprising a feeder motor and a feeder switching valve, said feeder switching valve controlling supply of a pressurized fluid to said feeder motor; and a control unit for stopping said feeder driving unit when an excessive load is detected by at least one of said first and second excessive load detectors, and actuating said feeder driving unit when an excessive load is not detected by both of said first and second excessive detectors, said control unit comprising a controller which switches said feeder switching valve into a closed position when the revolution speed detected by said revolution sensor is lower than or equal to the predetermined revolution speed and/or when the hydraulic pressure detected by said pressure sensor is higher than or equal to the predetermined pressure, and which switches said feeder switching valve into an open position when the detected revolution speed exceeds said predetermined revolution speed and said detected hydraulic pressure is lower than the predetermined pressure.

3. A self-propelled crushing machine according to claim 1 or 2, further comprising a crusher inching unit for inching said crusher driving unit in a normal and in a reverse direction.

4. A self-propelled crushing machine according to claim 3, wherein said crusher inching unit comprises a crusher normal drive switch and a crusher reverse drive switch for temporarily placing said crusher driving unit in a normal or a reverse driving condition.

5. A self-propelled crushing machine according to claim 4, wherein said hopper comprises a pair of first vertical panels and a second vertical panel, and wherein said panels have upper portions which are pivotable in a vertical direction.

6. A self-propelled crushing machine according to claim 4, further comprising a magnetic ore separator mounted on said vehicle body in opposition to said discharge conveyor.

7. A self-propelled crushing machine according to claim 4, further comprising:

a further switching valve connected to a driving power source of a main body portion of the vehicle body; and a vehicle body side connecting portion provided on said vehicle body, and connected to said further switching valve, and said vehicle body side connecting portion being further connected to driving motors of vehicle arrangements via piping members.

8. A self-propelled crushing machine according to claim 3, further comprising a feeder inching unit for inching said feeder driving unit.

9. A self-propelled crushing machine according to claim 8, wherein said feeder inching unit comprises a feeder driving switch for placing said feeder driving unit in a temporarily actuating condition by a manual operation.

10. A self-propelled crushing machine according to claim 9, wherein said hopper comprises a pair of first vertical panels and a second vertical panel, and wherein said panels have upper portions which are pivotable in a vertical direction.

11. A self-propelled crushing machine according to claim 9, further comprising a magnetic ore separator mounted on said vehicle body in opposition to said discharge conveyor.

12. A self-propelled crushing machine according to claim 9, further comprising:

a further switching valve connected to a driving power source of a main body portion of the vehicle body; and a vehicle body side connecting portion provided on said vehicle body, and connected to said further switching valve, and said vehicle body side connecting portion being further connected to driving motors of vehicle arrangements via piping members.

13. A self-propelled crushing machine according to claim 8, wherein said hopper comprises a pair of first vertical panels and a second vertical panel, and wherein said panels have upper portions which are pivotable in a vertical direction.

14. A self-propelled crushing machine according to claim 8, further comprising a magnetic ore separator mounted on said vehicle body in opposition to said discharge conveyor.

15. A self-propelled crushing machine according to claim 8, further comprising:

a further switching valve connected to a driving power source of a main body portion of the vehicle body; and a vehicle body side connecting portion provided on said vehicle body, and connected to said further switching valve, and said vehicle body side connecting portion being further connected to driving motors of vehicle arrangements via piping members.

16. A self-propelled crushing machine according to claim 8, wherein said feeder inching unit comprises a feeder driving switch for placing said feeder driving unit in a temporarily actuating condition by a manual operation.

17. A self-propelled crushing machine according to claim 3, wherein said hopper comprises a pair of first vertical panels and a second vertical panel, and wherein said panels have upper portions which are pivotable in a vertical direction.

18. A self-propelled crushing machine according to claim 3, further comprising a magnetic ore separator mounted on said vehicle body in opposition to said discharge conveyor.

19. A self-propelled crushing machine according to claim 3, further comprising:

a further switching valve connected to a driving power source of a main body portion of the vehicle body; and a vehicle body side connecting portion provided on said vehicle body, and connected to said further switching valve, and said vehicle body side connecting portion being further connected to driving motors of vehicle arrangements via piping members.

20. A self-propelled crushing machine according to claim 1 or 2, wherein said hopper comprises a pair of first vertical panels and a second vertical panel, and wherein said panels have upper portions which are pivotable in a vertical direction.

21. A self-propelled crushing machine according to claim 20, further comprising a magnetic ore separator mounted on said vehicle body in opposition to said discharge conveyor.

22. A self-propelled crushing machine according to claim 20, further comprising:

a further switching valve connected to a driving power source of a main body portion of the vehicle body; and a vehicle body side connecting portion provided on said vehicle body, and connected to said further switching valve, and said vehicle body side connecting portion being further connected to driving motors of vehicle arrangements via piping members.

23. A self-propelled crushing machine according to claim 2, further comprising a magnetic ore separator mounted on said vehicle body in opposition to said discharge conveyor.

24. A self-propelled crushing machine according to claim 23, further comprising:

a further switching valve connected to a driving power source of a main body portion of the vehicle body; and a vehicle body side connecting portion provided on said vehicle body, and connected to said further switching valve, and said vehicle body side connecting portion being further connected to driving motors of vehicle arrangements via piping members.

25. A self-propelled crushing machine according to claim 1 or 2, further comprising:

a further switching valve connected to a driving power source of a main body portion of the vehicle body; and a vehicle body side connecting portion provided on said vehicle body, and connected to said further switching valve, and said vehicle body side connecting portion being further connected to driving motors of vehicle arrangements via piping members.

26. A self-propelled crushing machine comprising:

a vehicle body;

a travelling body mounted on a lower portion of said vehicle body;

a crusher mounted on an upper portion of said vehicle body;

a hopper mounted on the upper portion of said vehicle body and having a feeder for supplying an object to be crushed to an inlet of said crusher;

a crusher driving unit for driving said crusher;

an excessive load detector for detecting whether or not an excessive load is acting on said crusher driving unit;

a feeder driving unit for driving said feeder;

a control unit for stopping said feeder driving unit when an excessive load is detected by said excessive load detector, and actuating said feeder driving unit when an excessive load is not detected; and a crusher inching unit for inching said crusher driving unit in a normal and in a reverse direction.

27. A self-propelled crushing machine according to claim 26, further comprising a feeder inching unit for inching said feeder driving unit.

28. A self-propelled crushing machine according to claim 27, wherein said feeder inching unit comprises a feeder driving switch for placing said feeder driving unit in a temporarily actuating condition by a manual operation.

29. A self-propelled crushing machine according to claim 26, wherein said crusher inching unit comprises a crusher normal drive switch and a crusher reverse drive switch for temporarily placing said crusher driving unit in a normal or a reverse driving condition.

30. A self-propelled crushing machine comprising:

a vehicle body;

a travelling body mounted on a lower portion of said vehicle body;

a crusher mounted on an upper portion of said vehicle body;

a hopper mounted on the upper portion of said vehicle body and having a feeder for supplying an object to be crushed to an inlet of said crusher;

a crusher driving unit for driving said crusher;

an excessive load detector for detecting whether or not an excessive load is acting on said crusher driving unit;

a feeder driving unit for driving said feeder;

a control unit for stopping said feeder driving unit when an excessive load is detected by said excessive load detector, and actuating said feeder driving unit when an excessive load is not detected;

a switching valve connected to a driving power source of a main body portion of the vehicle body; and a vehicle body side connecting portion provided on said vehicle body, and connected to said further switching valve, and said vehicle body side connecting portion being further connected to driving motors of vehicle arrangements via piping members.

31. A self-propelled crushing machine comprising:

a vehicle body;

a travelling body mounted on a lower portion of said vehicle body;

a crusher mounted on an upper portion of said vehicle body;

a hopper mounted on the upper portion of said vehicle body and having a feeder for supplying an object to be crushed to an inlet of said crusher;

a hopper mounted on the upper portion of said vehicle body and having a feeder for supplying an object to be crushed to an inlet of said crusher;

a discharge conveyor mounted on the lower portion of said vehicle body and receiving crushed pieces from an outlet of said crusher;

a crusher driving unit for driving said crusher;

a first excessive load detector for detecting whether or not an excessive load is acting on said crusher driving unit;

a discharge conveyor driving unit for driving said discharge conveyor;

a second excessive load detector for detecting whether or not an excessive load is acting on said conveyor driving unit, a feeder driving unit for driving said feeder;

a control unit for stopping said feeder driving unit when an excessive load is detected by at least one of said first and second excessive load detectors, and actuating said feeder driving unit when an excessive load is not detected by both of said first and second excessive detectors; and a crusher inching unit for inching said crusher driving unit in a normal and in a reverse direction.

32. A self-propelled crushing machine according to claim 31, further comprising a feeder inching unit for inching said feeder driving unit.

33. A self-propelled crushing machine according to claim 32, wherein said feeder inching unit comprises a feeder driving switch for placing said feeder driving unit in a temporarily actuating condition by a manual operation.

34. A self-propelled crushing machine according to claim 31, wherein said crusher inching unit comprises a crusher normal drive switch and a crusher reverse drive switch for temporarily placing said crusher driving unit in a normal or a reverse driving condition.

35. A self-propelled crushing machine comprising:

a vehicle body;

a travelling body mounted on a lower portion of said vehicle body;

a crusher mounted on an upper portion of said vehicle body;

a hopper mounted on the upper portion of said vehicle body and having a feeder for supplying an object to be crushed to an inlet of said crusher;

a hopper mounted on the upper portion of said vehicle body and having a feeder for supplying an object to be crushed to an inlet of said crusher;

a discharge conveyor mounted on the lower portion of said vehicle body and receiving crushed pieces from an outlet of said crusher;

a crusher driving unit for driving said crusher;

a first excessive load detector for detecting whether or not an excessive load is acting on said crusher driving unit;

a discharge conveyor driving unit for driving said discharge conveyor;

a second excessive load detector for detecting whether or not an excessive load is acting on said conveyor driving unit, a feeder driving unit for driving said feeder;

a control unit for stopping said feeder driving unit when an excessive load is detected by at least one of said first and second excessive load detectors, and actuating said feeder driving unit when an excessive load is not detected by both of said first and second excessive detectors; and a switching valve connected to a driving power source of a main body portion of the vehicle body; and a vehicle body side connecting portion provided on said vehicle body, and connected to said further switching valve, and said vehicle body side connecting portion being further connected to driving motors of vehicle arrangements via piping members.

* * * * *